US007261050B2

(12) United States Patent
Brauers et al.

(10) Patent No.: US 7,261,050 B2
(45) Date of Patent: Aug. 28, 2007

(54) SURFING DEVICE

(76) Inventors: Sven Brauers, Velberstrasse 7a, D-30451 Hannover (DE); Rouven Brauers, Kepplerstraat 304, NL-2562 VX The Hague (NL)

( * ) Notice: Subject to any disclaimer, the term of this patent is extended or adjusted under 35 U.S.C. 154(b) by 0 days.

(21) Appl. No.: 10/524,296

(22) PCT Filed: Apr. 4, 2003

(86) PCT No.: PCT/EP03/03531

§ 371 (c)(1),
(2), (4) Date: Apr. 15, 2005

(87) PCT Pub. No.: WO2004/022422

PCT Pub. Date: Mar. 18, 2004

(65) Prior Publication Data

US 2005/0260901 A1 Nov. 24, 2005

(30) Foreign Application Priority Data

Aug. 14, 2002 (DE) ..... 102 37 921

(51) Int. Cl.
*B63B 5/24* (2006.01)

(52) U.S. Cl. ..... 114/357; 441/74

(58) Field of Classification Search ..... 114/357; 441/74

See application file for complete search history.

(56) References Cited

U.S. PATENT DOCUMENTS

| | | | | |
|---|---|---|---|---|
| 4,158,082 | A * | 6/1979 | Belousofsky | 428/102 |
| 5,295,883 | A * | 3/1994 | Moran | 441/65 |
| 5,816,876 | A * | 10/1998 | Hamilton | 441/74 |
| 6,026,760 | A * | 2/2000 | Phillips et al. | 114/267 |
| 6,394,864 | B2 * | 5/2002 | Scharl | 441/65 |

FOREIGN PATENT DOCUMENTS

| | | |
|---|---|---|
| CH | 597 032 | 3/1978 |
| DE | 41 28 957 | 3/1993 |
| EP | 0 048 651 | 3/2002 |
| FR | 2 787 088 | 6/2000 |

* cited by examiner

*Primary Examiner*—Stephen Avila
(74) *Attorney, Agent, or Firm*—Robert W Becker & Associates; Robert W Becker

(57) ABSTRACT

A surfing device is provided comprising a board-like body having a foam core, an upper side, and a lower side. The foam core is encased in laminate, wherein at least an edge region of at least one of the front longitudinal end, the rear longitudinal end, the left side, and the right side of the board-like body is provided with at least two woven laminate plies, at least one of which extends from the upper side to the lower side, or vice versa, about a profile of the corresponding end or side.

44 Claims, 1 Drawing Sheet

SURFING DEVICE

BACKGROUND OF THE INVENTION

The invention relates to a surfing device or the like, especially a surfboard, having a board-like body that is provided with a foam core, which is encased with a laminate, and an upper side and a lower side.

Normally, surfing devices having a board-like body, so-called surfboards, are provided with a foam core that is encased with laminate and have an upper side and a lower side. If the resin of the laminates is made of a polyester, the foam cores are provided with a slat-shaped device, the so-called "stringer", generally made of wood for stabilizing the surfboard.

However, the drawback in this regard is the fact that such surfboards are generally subjected to a high rate of wear, which is manifested in irreversible unevenness of the surface all the way to breaking of the boards.

Surfboards are also known where the laminate layers generally contain glass fiber fabric and epoxy resin, whereby, however, these can only be produced in prefabricated shapes without being able to address the requirements of individual surfers. These surfboards generally have no stringer, since due to the epoxy resin, in conjunction with glass fiber fabric that is normally used, an adequate strength can be realized.

However, a drawback in this regard is the fact that due to the joining of two molded parts over the foam core to form a surfboard, there classically occurs at the seam between the two halves a weak spot such that with little surface damage in this region the foam core can absorb up to about 10% water, which due to the rapid distribution in the foam body itself can only be removed or carried away with great difficulty, which leads to long repair and down times, and repairs are possible only to a very limited extent.

The object of the present invention is to at least partially avoid the aforementioned drawbacks, and in particular to provide devices and methods for producing devices of the aforementioned type, especially for surfing with a board-like body, which in comparison to conventional surfboards have a considerably longer service life, thereby greatly reducing the danger of a board breaking, whereby an individual adaptation to the individual surfer is possible.

SUMMARY OF THE INVENTION

This object is inventively realized by a device and a method.

The inventive device for surfing or the like is provided with a board-like body that has a foam core that is encased in laminate, with the board-like body also having an upper side and a lower side. At least the edge region of the front and/or rear longitudinal end and/or the left and/or the right side of the board-like body is provided—or possibly each (i.e. the front and rear longitudinal end and/or the right and left side) is provided—with at least two woven laminate plies, at least one of which extends from the upper to the lower side, or vice versa, about the profile of the longitudinal end.

Due to this special configuration, the inventive device is provided at least at one of its ends with an elasticity that is considerably greater than that of conventional surfboards. Due to the multiple—in particular double—lamination, the edge regions, especially of the longitudinal ends and/or sides, have a considerably greater strength or resistance, so that the regions that are stressed the most now have a lower probability of breaking. Important to the invention is the fact that the present surfing device, especially at its longitudinal ends and/or sides, has a greater reversible elongation about the longitudinal axis or transverse axis respectively than do conventional surfboards, so that unevenness or roughness on the wave that is to be surfed can be quasi "absorbed" as with a shock absorber. The inventive devices can therefore be surfed more rapidly and in a more controlled manner, and can withstand even the greatest stresses in the wave with formations of up to 30 cm. Furthermore, the longitudinal and/or transverse profile of the inventive devices adapt to those of the constantly changing shapes of the waves. In addition, the weight is merely one-half of that of conventional boards.

It is initially advantageous if respectively at least one woven laminate ply of the upper and lower side extends about the profile of the front and/or rear longitudinal end and/or the left and/or right side from the upper to the lower side, or vice versa, since in this way it is possible to realize a high resistance to breaking in both elongation directions.

To enhance an elongation that is uniform in both elongation directions, it is advantageous for the respectively at least one woven laminate ply of the upper and lower side to rest directly upon one another in the edge region of the front and/or rear longitudinal end and/or the left and/or right side.

Furthermore, it is advantageous if the ratio of the overall laminate layer thicknesses from upper to lower side is in the range of from 6:4 to 5:5, especially if the overall laminate layer thicknesses from upper side to lower side are equal to one another, since with these features excellent service lives could be achieved, because not only a curving up but also a curving down of the longitudinal ends and/or sides is possible at least to nearly the same extent.

It is furthermore advantageous if the number of laminated woven layers of the upper side and lower side are the same, and in additional if the layer thicknesses of the individual woven layers are at least nearly identical and/or the woven material is chemically similar in order in this manner also here to enable a high and controlled ability of the longitudinal ends and/or sides to deflect.

This is advantageously reinforced and realized such that the bending and torsion stresses that occur can be absorbed uniformly in that at least a portion, and especially all, of the woven layers of the upper and lower sides in the edge region of at least one forward and/or rear longitudinal end and/or left and/or right side have their layer sequence alternate (alternating lamination upon one another of woven layers of the upper and lower side, or vice versa).

In this connection, it has been shown and practiced to be decidedly advantageous for the woven material to comprise glass fibers and/or aramid.

Aramids are polyamides of aromatic diamines and aromatic dicarbonic acids that in addition to amide can also contain imide groups. Aramids are characterized by high thermal and chemical resistance, strength and elasticity as well as good flame resistance and inherent stability.

In practice, advantageous weight per unit area of woven material for glass fibers have shown to be at 80 $g/m^2$ to 330 $g/m^2$, and for aramid at 60 $g/m^2$ to 240 $g/m^2$, as well as woven material that unidirectionally correspond to at least one type of weave from the group linen, twill ⅓, twill ⅔. Woven material, such as, for example, glass fiber and aramid fiber woven material, are present in woven lengths of endless threads or yarns, whereby the threads are spun filaments generally having a slight twist (10 to 40 twists per meter) and the yarns generally have a greater twist (100 to 200 twists per meter).

An adhesive is frequently applied to the woven material that serves for an improved connection with, in particular, epoxy resins (epoxide resins). Such laminates demonstrate higher strengths and a better resistance to water and aging.

The type of weave is the type of filament cross-weaving in the warp (longitudinal) and weft (transverse) direction. With the linen type of weave a simple basic type of weave is involved where the weft thread respectively crosses a warp thread. This type ensures a good dimensional stability and little fraying when cutting. With the twill type of weave, a plurality of warp threads are skipped, so that as a consequence woven material having a high flexibility and ability to drape results that is particularly suitable for curved shapes, but cannot be cut as easily.

Woven material is called unidirectional when it contains thin weft threads, so that as a result more warp threads can be accommodated in the laminate with the same fraction of resin material. Due to the thread tension, one thus obtains a considerably greater strength and rigidity in the longitudinal direction.

Good results can be achieved with foam cores of polyurethane or polystyrene.

So that if damage occurs to the laminate layer and the foam core is exposed the latter does not, upon contact with water, swell excessively or absorb water, the core has a closed cell structure which can be realized by modifying the foam via conventional additives.

It has proven particularly satisfactory in practice if the woven plies of the laminate are soaked in epoxy resin and/or furthermore the device is free of stringers, since in this way it is possible to achieve a particularly high ability to deflect about the longitudinal and/or transverse axis (flexibility) and hence a very high strength while saving a considerable amount of weight.

Finally, it is advantageous if the inner surface of the foam core is essentially free of dust, since during the laminating-on of the first woven layer upon the foam core there is in this way produced an extremely strong connection, since otherwise if dust particles are present the strength of the adhesion of the laminate to the foam core would be greatly reduced and delamination would frequently occur.

By using an aforementioned epoxy resin (epoxide resin) in the laminate layer, the forces that occur are absorbed directly by the glass fibers or the aramid, for example in the form of fibers, so that normally deformations up to about 30 cm (!) are possible. The thickness of the upper and lower side can be considerably reduced due to the aforementioned multiple lamination that is carried out at least in the edge region. The weight of the inventive device can be considerably reduced relative to conventional boards, and even by one-half with embodiments having no stringer. The service life of these devices should be increased by about a factor of 4 in comparison to conventional boards. With the inventive configuration, the board-like body of the inventive device is provided with footprints of the surfer after appropriate use. As a result, the surfer has a better position and a better control over his board. The resulting impressions are in the range of 2 to 8 mm in depth and then become stagnant, without negatively influencing the quality of the board, as a result of which an optimum transfer of force from the foot to the board are achieved. The footprints generally do not lead, as is otherwise usual, to later delaminations of the laminate from the foam core.

Pursuant to the invention, it is in principle adequate if the overlap of the woven laminate plies in the edge region of the board-like body in the peripheral direction extend only over a portion of the length of the body in this direction. For example, the overlap can be formed in a plurality of short regions that follow one another in the peripheral direction and are spaced from one another. To achieve the inventive characteristics and advantages to a particularly substantial extent, it is proposed pursuant to an extremely advantageous further development of the invention that the overlap of the woven laminate plies in the edge region of the board-like body in the peripheral direction of the body extend over a considerable portion of the length of the body, preferably essentially over the entire length of the body in this direction.

To achieve a resistance of the board-like body against UV radiation, it is expedient that the board-like body be provided with UV-resistant material in the region of its surface, especially on its surface.

With the aforementioned embodiment, the UV-resistant material can be contained in the laminate or can form a coating of the board-like body.

With the inventive method for producing a device for surfing and the like, especially for kite surfing and wake boarding, especially for the production of an inventive device, at least one edge region of the front and/or rear longitudinal edge and/or the left and/or right side of the foam core of the board-like body is encased, in a laminating manner, from the upper to the lower side, or vice versa, about the profile with at least one woven ply, whereby after complete lamination, at least the edge region of the corresponding end and/or side that has the at least one woven ply is provided with at least one further woven laminate ply.

This can be carried out manually, semi-automatically or fully automatically in machines that are appropriate therefor (conventionally known as vacuum technologies).

The assertions made with regard to the inventive device pertaining to the advantageous embodiments also apply in an analogous manner relative to the dependent claims of the inventive method.

It is furthermore advantageous if prior to the lamination resin and/or lightweight filler is applied to the surface of the foam core, so that the surface of the foam core is nearly sealed and a defined surface is provided for the laminating-on of the appropriate woven material.

The inventive device is preferably a surfboard. However, the inventive device, can, for example, also be a skim board, a wake board, a wake skate, a kite board, a knee board, a body board, a windsurf board, a water ski, a mono ski or some other similar sport device.

By way of example, with the inventive method the following method steps are carried out:

1. shaping a foam core,
2. cleaning the surface of the foam core,
3. applying resin and/or lightweight filler upon the surface of the foam core,
4. laminating the base,
5. smoothing the edge regions of the longitudinal ends,
6. laminating the surface,
7. grinding the entire surface,
8. applying resin,
9. smoothing the surface,
10. applying a surface lacquer,
11. very fine grinding or smoothing of the surface and applying a finish.

BRIEF DESCRIPTION OF THE DRAWINGS

The following examples serve to explain the invention in greater detail.

In the figures.

DESCRIPTION OF SPECIFIC EMBODIMENTS

Figure 1:
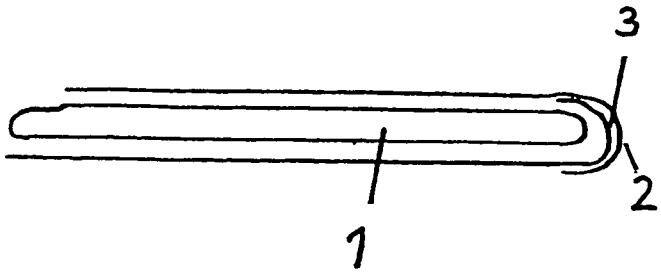
FIG. 1 shows a schematic illustration of a first embodiment of the inventive device.

FIG. 1 schematically shows a first embodiment of the inventive device.

With this embodiment, a foam core 1 comprised of polyurethane foam is laminated at the right longitudinal end with two woven strips 2,3 such that the upper woven strip 2, from the upper side to the lower side, and the lower woven strip 3, from the lower side to the upper side, are disposed in a laminated manner so as to extend about the profile of the longitudinal end. The woven material is glass filament woven material having a weight per unit area of 163 g/m$^2$ (type of weave: linen) (supply source: Lange+Ritter).

Figure 2:
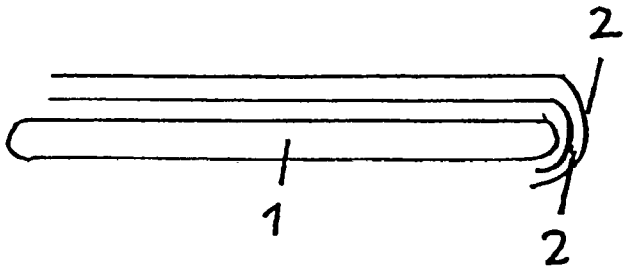
FIG. 2 shows a second embodiment of the inventive device.

FIG. 2 schematically shows a second embodiment of the inventive device.

With this embodiment, a foam core 1 comprised of polyurethane is again multiply laminated at the right side (this time by two upper woven strips 2, 2') so as to extend about the profile of the longitudinal end in such a way that both upper woven strips 2, 2' extend from the upper side to the lower side. FIGS. 1 and 2 illustrate that the woven strips 2, 3 overlap merely in the region of the right end of the board-like body 1. It is to be understood that the woven strips 2, 3 could also overlap at the right side as well as at the left side. It is of course also possible that both woven strips extend from the bottom to the top. Furthermore, the figures can also be understood such that these figures do not—as above—show the longitudinal profile but rather the transverse profile, and that the woven strips shown there are lateral woven strips.

Figure 3:
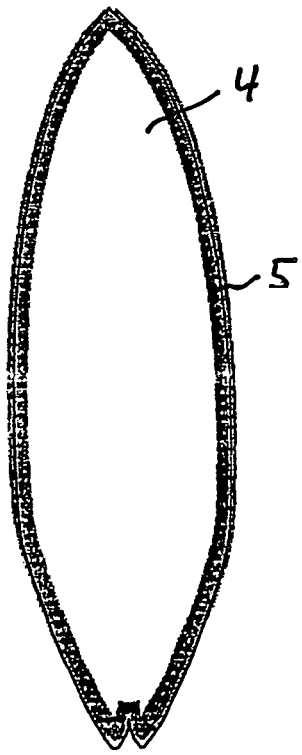
FIG. 3 shows a very schematic top view upon an inventive device.

FIG. 3 shows a very schematic plan or top view upon an inventive device in the form of a surfboard. FIG. 3 illustrates a board-like body 4 of the device, whereby the gray shading 5 illustrates that the overlap of the woven strips 2, 3 described with the aid of FIGS. 1 and 2 in the edge region of the board-like body 4 in the peripheral direction of the body 4 with this embodiment extends over the entire length of the body 4 in the peripheral direction thereof. In this way, the characteristics and advantages of the invention are achieved to a particularly substantial extent.

With the aforementioned embodiments, an epoxy resin having the designation L-285 of the company Lange+Ritter is used. Used as a lightweight filler can be a product having the designation Q-Cell (article number 12.87 of the company Lange+Ritter).

The foam can be the commercially known products designated as Surfoam, Clarkfoam, Bennet, Burford, Phenolic Megalite, Starwalt, Styrodur and Jackodur.

Manufacture of a inventive surfboard having no stringer.

1. Initially bringing a foam body produced of polyurethane foam into a surfboard like shape (shaping).
2. Subsequently the shaped foam body (blank) is freed of dust particles on the surface with the aid of suction turbines or vacuum cleaners.
3. Thereafter applying an epoxy resin or a so-called lightweight filler to the surface to produce a reproduceable surface.
4. First coating the underside of the foam body in a laminating matter with the aid of a glass filament woven material (163 g/m$^2$). In this connection, an aramid fiber woven material having a weight per unit area of 110 g/m$^2$ can also be used.
5. Subsequently thereto, the edge region of the laminated end is ground to provide a larger surface area for the further woven layer that is still to be laminated on.
6. Subsequently appropriately laminating the surface with a woven material.
7. Thereafter grinding the entire surface to provide a larger surface area for the application of a surface resin (top coat).
8. Applying an appropriately suitable surface resin, especially an epoxy resin, to the surface of the laminate.
9. The surface is ground with a coarseness of 80 to 400,
10. A surface lacquer, especially an acrylic lacquer, is applied and finally
11. A very fine smoothing with a subsequent application of a polishing or finishing agent is carried out.

The steps 2, 3, 10 and 11 are, however, optional steps for optimizing the product.

For the application of the woven material surfaces, the classic process of hand application as well as vacuum technologies (for example the known so-called vacuum infusion technique, vasi) could be used.

The specification incorporates by reference the disclosure of German priority document 102 37 921.1 filed Aug. 14, 2002 and PCT/EP2003/003531 filed 04 Apr. 2003.

The present invention is, of course, in no way restricted to the specific disclosure of the specification and drawings, but also encompasses any modifications within the scope of the appended claims.

The invention claimed is:

1. A surfing device comprising:

a board-like body having a foam core, an upper side and a lower side, wherein said foam core is encased in laminate, wherein at least an edge region of at least one of a front longitudinal end, a rear longitudinal end, a left side, and a right side of said board-like body is provided with at least two woven laminate plies, wherein at least one of said plies extends from said upper side to said lower side, or vice versa, about a profile of a corresponding end or side, and wherein a ratio of overall laminate layer thicknesses from the upper side to the lower side is in the range of from 6:4 to 5:5.

2. A device according to claim 1, wherein respectively at least one woven laminate ply of the upper side and lower side extends about the profile of at least one of the front longitudinal end, the rear longitudinal end, the left side and the right side from the upper side to the lower side, or vice versa.

3. A device according to claim 1, wherein respectively at least one woven laminate ply of the upper side and the lower side in the edge region of at least one of the front longitudinal end, the rear longitudinal end, the left side, and the right side rest directly on one another.

4. A device according to claim 1, wherein overall laminate layer thicknesses from the upper side to the lower side are of the same magnitude.

5. A device according to claim 1, wherein the number of laminated woven layers of the upper side and lower side is the same.

6. A device according to claim 1, wherein layer thicknesses of individual woven layers are at least nearly identical.

7. A device according to claim 1, wherein woven materials are chemically similar.

8. A device according to claim 1, wherein at least a portion of woven layers of the upper side and of the lower side, in the edge region of at least one of the front longitudinal end, the rear longitudinal end, the left side, and the right side is arranged in an alternating sequence.

9. A device according to claim 8, wherein all woven layers of the upper side and the lower side, in the edge region of at least one of the front longitudinal end, the rear longitudinal end, the left side, and the right side, are arranged in an alternating sequence.

10. A device according to claim 1, wherein said woven plies are comprised of at least one of the group consisting of glass fibers and aramid.

11. A device according to claim 10, wherein the weight per unit area of said woven plies is 80 to 330 g/m$^2$ for glass fibers, and 60 to 240 g/m$^2$ for aramid.

12. A device according to claim 1, wherein said woven plies unidirectionally correspond to at least one of the types of weave selected from the group consisting of linen, twill ⅓ and twill ⅔.

13. A device according to claim 1, wherein said foam core is composed of polyurethane or polystyrene.

14. A device according to claim 1, wherein said foam core has a closed cell structure.

15. A device according to claim 1, wherein said woven plies are soaked in epoxy resin.

16. A device according to claim 1, wherein said device has no stringer.

17. A device according to claim 1, wherein an inner surface of said foam core is essentially free of dust.

18. A device according to claim 1, wherein said woven laminate plies overlap in the edge region of said board-like body in a peripheral direction of said body, and wherein such overlap extends over a substantial portion of the length of the body or essentially over the entire length of the body.

19. A device according to claim 1, wherein said board-like body is provided with a UV-resistant material in the region of the surface, or on the surface, of said body.

20. A device according to claim 19, wherein said UV-resistant material is contained in said laminate or forms a coating of said board-like body.

21. A method of producing a surfing device, including the steps of:

providing a board-like body having a foam core;

encasing, in a laminating manner, at least an edge region of at least one of a front longitudinal end, a rear longitudinal end, a left side, and a right side of said foam core with at least one woven ply that extends from an upper side to a lower side of said board-like body, or vice versa, about a profile of the corresponding end or side; and after complete lamination, providing at least the edge region of the corresponding end or side that has the at least one woven ply with at least one further woven laminate ply, and wherein a ratio of overall laminate layer thicknesses from the upper side to the lower side is in the range of from 6:4 to 5:5.

22. A method according to claim 21, wherein respectively at least one woven laminate ply of the upper side and lower side extends about the profile of at least one of the front longitudinal end, the rear longitudinal end, the left side and the right side from the upper side to the lower side, or vice versa.

23. A method according claims 21, wherein respectively at least one woven laminate ply of the upper side and the lower side in the edge region of at least one of the front longitudinal end, the rear longitudinal end, the left side, and the right side rest directly on one another.

24. A method according claims 21, wherein overall laminate layer thicknesses from the upper side to the lower side are of the same magnitude.

25. A method according claim 21, wherein the number of laminated woven layers of the upper side and lower side is the same.

26. A method according claim 21, wherein layer thicknesses of individual woven layers are at least nearly identical.

27. A method according to claim 21, wherein woven materials are chemically similar.

28. A method according to claim 21, wherein at least a portion of woven layers of the upper side and of the lower side, in the edge region of at least one of the front longitudinal end, the rear longitudinal end, the left side, and the right side is arranged in an alternating sequence.

29. A method according claim 28, wherein all woven layers of the upper side and the lower side, in the edge region of at least one of the front longitudinal end, the rear longitudinal end, the left side, and the right side, are arranged in an alternating sequence.

30. A method according to claim 21, wherein said woven plies are comprised of at least one of the group consisting of glass fibers and aramid.

31. A method according to claim 30, wherein the weight per unit area of said woven plies is 80 to 330 g/m$^2$ for glass fibers, and 60 to 240 g/m$^2$ for aramid.

32. A method according to claim 21, wherein said woven plies unidirectionally correspond to at least one of the types of weave selected from the group consisting of linen, twill ⅓ and twill ⅔.

33. A method according to claim 21, wherein said foam core is composed of polyurethane or polystyrene.

34. A method according to claim 21, wherein said foam core has a closed cell structure.

35. A method according to claim 21, wherein said woven plies are soaked in epoxy resin.

36. A method according to claim 21, wherein said device has no stringer.

37. A method according to claim 21, which includes the further step of essentially freeing a surface of said foam core of dust particles prior to said encasing step.

38. A method according to claim 21, wherein prior to said encasing step, at least one of resin and lightweight filler is applied to a surface of said foam core.

39. A method according to claim 21, wherein said board-like body is provided with a UV-resistant material in the region of the surface, or on the surface, of said body.

40. A method according to claim 39, wherein said UV-resistant material is contained in said laminate or forms a coating of said board-like body.

41. A surfing device comprising:

a board-like body having a foam core, an upper side and a lower side, wherein said foam core is encased in laminate, wherein at least an edge region of at least one of a front longitudinal end, a rear longitudinal end, a left side, and a right side of said board-like body is provided with at least two woven laminate plies, wherein said woven plies are comprised of at least one of the group consisting of glass fibers and aramid, wherein the weight per unit area of said woven plies is 80 to 330 g/m$^2$ for glass fibers, and 60 to 240 g/m$^2$ for aramid, and wherein at least one of said plies extends from said upper side to said lower side, or vice versa, about a profile of a corresponding end or side.

42. A device according to claim 1, wherein a ratio of overall laminate layer thicknesses from the upper side to the lower side is in the range of from 6:4 to 5:5.

43. A method of producing a surfing device, including the steps of providing a board-like body having a foam core;

encasing, in a laminating manner, at least an edge region of at least one of a front longitudinal end, a rear longitudinal end, a left side, and a right side of said foam core with at least one woven ply that extends from an upper side to a lower side of said board-like body, or vice versa, about a profile of the corresponding end or side; and after complete lamination, providing at least the edge region of the corresponding end or side that has the at least one woven ply with at least one further woven laminate ply, wherein said woven plies are comprised of at least one of the group consisting of glass fibers and aramid, and wherein the weight per unit area of said woven plies is 80 to 330 g/m$^2$ for glass fibers, and 60 to 240 g/m$^2$ for aramid.

44. A method according claims 43, wherein a ratio of overall laminate layer thicknesses from the upper side to the lower side is in the range of from 6:4 to 5:5.

* * * * *

UNITED STATES PATENT AND TRADEMARK OFFICE

CERTIFICATE OF CORRECTION

PATENT NO. : 7,261,050 B2
APPLICATION NO. : 10/524296
DATED : August 28, 2007
INVENTOR(S) : Brauers et al.

It is certified that error appears in the above-identified patent and that said Letters Patent is hereby corrected as shown below:

Title page,

Item [86] should read as follows:

[86] PCT No.: PCT/EP03/03531

§ 371 (c)(1),
(2), (4) Date: Apr. 14, 2005

Signed and Sealed this

Twenty-seventh Day of November, 2007

JON W. DUDAS
*Director of the United States Patent and Trademark Office*